US011986015B2

(12) United States Patent
He et al.

(10) Patent No.: US 11,986,015 B2
(45) Date of Patent: May 21, 2024

(54) ATOMIZING DEVICE

(71) Applicant: Cheng Uei Precision Industry Co., LTD., New Taipei (TW)

(72) Inventors: Xiang-Cheng He, Dong-Guan (CN); Rong-Sheng Xie, Dong-Guan (CN); Zan-Guo Zhou, Dong-Guan (CN); Ming-Cheng Zi, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 421 days.

(21) Appl. No.: 17/528,185

(22) Filed: Nov. 16, 2021

(65) Prior Publication Data

US 2022/0361571 A1 Nov. 17, 2022

(30) Foreign Application Priority Data

May 12, 2021 (CN) ..... 202121015941.4

(51) Int. Cl.

| | |
|---|---|
| ***A24F 40/42*** | (2020.01) |
| ***A24F 40/10*** | (2020.01) |
| ***A24F 40/46*** | (2020.01) |
| ***A24F 40/485*** | (2020.01) |

(52) U.S. Cl.

CPC ..... *A24F 40/42* (2020.01); *A24F 40/10* (2020.01); *A24F 40/46* (2020.01); *A24F 40/485* (2020.01)

(58) Field of Classification Search

CPC ..... A24F 40/42; A24F 40/10; A24F 40/46; A24F 40/485

See application file for complete search history.

(56) References Cited

U.S. PATENT DOCUMENTS

| | | | | |
|---|---|---|---|---|
| 11,910,829 | B1 * | 2/2024 | Edwards | A24F 40/42 |
| 2015/0272217 | A1 * | 10/2015 | Chen | A24F 40/485 131/329 |
| 2016/0015082 | A1 * | 1/2016 | Liu | A24F 40/44 131/329 |
| 2018/0098575 | A1 * | 4/2018 | Liu | A61M 11/042 |
| 2018/0343923 | A1 * | 12/2018 | Chen | A24F 40/485 |
| 2019/0191781 | A1 * | 6/2019 | Lin | H05B 3/00 |
| 2019/0297950 | A1 * | 10/2019 | Wendt Thevenaz | A24F 40/42 |
| 2020/0029624 | A1 * | 1/2020 | Liu | A24F 40/49 |
| 2020/0100543 | A1 * | 4/2020 | Welliver | A24F 40/10 |

(Continued)

*Primary Examiner* — Truc T Nguyen

(74) *Attorney, Agent, or Firm* — Cheng-Ju Chiang

(57) ABSTRACT

An atomizing device includes a liquid containing module and an atomizing assembly. An inside of the liquid containing module has a fixing element and a liquid storage container. The liquid containing module has a flowing channel communicated with the fixing element. The liquid storage container surrounds a peripheral wall of the flowing channel and an outer surface of the fixing element. The fixing element has an accommodating space. A side wall of the accommodating space has at least one first liquid guiding groove. The accommodating space is equipped with a bushing. A side wall of the bushing has at least one second liquid guiding groove. The atomizing assembly is mounted under the liquid containing module. The atomizing assembly is equipped with an atomizing core module assembled in the bushing. A side wall of the atomizing core module has at least one third liquid guiding groove.

15 Claims, 15 Drawing Sheets

(56) References Cited

U.S. PATENT DOCUMENTS

| | | | | |
|---|---|---|---|---|
| 2020/0297033 | A1* | 9/2020 | Wang | H02J 7/0063 |
| 2021/0076733 | A1* | 3/2021 | Liu | B05B 17/0684 |
| 2021/0093018 | A1* | 4/2021 | Chen | A24F 40/00 |
| 2021/0219619 | A1* | 7/2021 | Chih | A24F 40/51 |
| 2022/0142246 | A1* | 5/2022 | Liu | A24F 40/40 |
| 2023/0134641 | A1* | 5/2023 | Lu | A24F 40/42 131/329 |

* cited by examiner

ATOMIZING DEVICE

CROSS-REFERENCE TO RELATED APPLICATION

The present application is based on, and claims priority from, China Patent Application No. 202121015941.4, filed May 12, 2021, the disclosure of which is hereby incorporated by reference herein in its entirety.

BACKGROUND OF THE INVENTION

1. Field of the Invention

The present invention generally relates to an atomizing device, and more particularly to an atomizing device capable of controlling a connection or a separation between a liquid storage container and an atomizing core module.

2. The Related Art

Generally, a conventional atomizing device includes an atomizing core module and a liquid storage container. The atomizing core module is designed to be integrated with the liquid storage container. The atomizing device is a closed type, an open type or a disposable type, etc. When liquid in the conventional atomizing device is exhausted, the liquid storage container and the atomizing core module need discarding together, and then the liquid storage container and the atomizing core module can be replaced, consequently, an extra cost for a replacement is caused. Because the liquid storage container and the atomizing core module are usually in a connection state, the liquid is easy to be accumulated in the atomizing core module, and the liquid easily leaks from a suction element of the conventional atomizing device, in that case, a waste of the liquid is caused, or a usage feeling of the conventional atomizing device is affected.

Thus, it is necessary to provide an innovative atomizing device capable of controlling a connection or a separation between a liquid storage container and an atomizing core module, so that the liquid storage container and the atomizing core module are able to be separated independently, and an excessive liquid accumulation in the atomizing core module is avoided.

SUMMARY OF THE INVENTION

An object of the present invention is to provide an atomizing device. The atomizing device includes a liquid containing module and an atomizing assembly. An inside of the liquid containing module has a fixing element and a liquid storage container. A middle of an inside of the liquid containing module has a flowing channel penetrating through a top of the liquid containing module and extending downward. The flowing channel is communicated with a top of the fixing element. The liquid storage container surrounds a peripheral wall of the flowing channel and an outer surface of the fixing element. The fixing element has an accommodating space penetrating through the top of the fixing element and a bottom of the fixing element. A side wall of the accommodating space has at least one first liquid guiding groove. A bottom of the accommodating space has an opening. The opening is communicated between the accommodating space and the at least one first liquid guiding groove. An inside of the accommodating space is equipped with a bushing. A side wall of the bushing has at least one second liquid guiding groove. The bushing moves upward or downward in the accommodating space. The bushing moves upward or downward along an axis direction, so that the at least one first liquid guiding groove and the at least one second liquid guiding groove are connected or disconnected. The atomizing assembly is mounted under the liquid containing module. The atomizing assembly is equipped with an atomizing core module. The atomizing core module is assembled in the bushing. A side wall of the atomizing core module has at least one third liquid guiding groove. The atomizing core module and the bushing move upward or downward in the accommodating space to make the at least one second liquid guiding groove and the at least one third liquid guiding groove move upward or downward, the at least one second liquid guiding groove and the at least one third liquid guiding groove are aligned with or misaligned with the at least one first liquid guiding groove, the at least one second liquid guiding groove and the at least one third liquid guiding groove are connected with or disconnected from the at least one first liquid guiding groove.

Another object of the present invention is to provide an atomizing device. The atomizing device includes a liquid containing module and an atomizing assembly. An inside of the liquid containing module has a fixing element and a liquid storage container. A middle of an inside of the liquid containing module has a flowing channel penetrating through a top of the liquid containing module and extending downward. The flowing channel is communicated with a top of the fixing element. The liquid storage container surrounds a peripheral wall of the flowing channel and an outer surface of the fixing element. The fixing element has an accommodating space penetrating through the top of the fixing element and a bottom of the fixing element. A side wall of the accommodating space has at least one first liquid guiding groove. A bottom of the accommodating space has an opening. The opening is communicated between the accommodating space and the at least one first liquid guiding groove. An inside of the accommodating space is equipped with a bushing. A side wall of the bushing has at least one second liquid guiding groove. The bushing moves upward or downward in the accommodating space, so that the at least one first liquid guiding groove and the at least one second liquid guiding groove are connected or disconnected. The atomizing assembly is mounted under the liquid containing module. The atomizing assembly is equipped with an atomizing core module. The atomizing core module is assembled in the bushing. A side wall of the atomizing core module has at least one third liquid guiding groove. The atomizing core module and the bushing move upward or downward in the accommodating space to make the at least one second liquid guiding groove and the at least one third liquid guiding groove move upward or downward, the at least one second liquid guiding groove and the at least one third liquid guiding groove are aligned with or misaligned with the at least one first liquid guiding groove, the at least one second liquid guiding groove and the at least one third liquid guiding groove are connected with or disconnected from the at least one first liquid guiding groove. When the atomizing core module and the bushing move upward to the top of the fixing element along a distance, the atomizing core module and the bushing are blocked by the top of the fixing element, the at least one first liquid guiding groove, the at least one second liquid guiding groove and the at least one third liquid guiding groove are aligned, and the at least one first liquid guiding groove, the at least one second liquid guiding groove and the at least one third liquid guiding groove are connected, so that the liquid containing module is located at an opened status, when the atomizing core module and the bushing move downward to the bottom of the fixing element, the at least one first liquid guiding groove, the at least one second liquid guiding groove and the at least one third liquid guiding groove are misaligned, and the at least one first liquid guiding groove, the at least one second liquid guiding groove and the at least one third liquid guiding groove are disconnected, so that the liquid containing module is located at a closed status.

Another object of the present invention is to provide an atomizing device. The atomizing device includes a liquid containing module, a bushing, an atomizing assembly and a rod element. The liquid containing module has an outer surrounding wall and an inner surrounding wall. The outer surrounding wall surrounds the inner surrounding wall. The outer surrounding wall is spaced from the inner surrounding wall. A liquid storage container is formed between the outer surrounding wall and the inner surrounding wall. A flowing channel is surrounded by a top portion of the inner surrounding wall, and an accommodating space is surrounded by a bottom portion of the inner surrounding wall and is communicated with the flowing channel. The bottom portion of the inner surrounding wall has at least one first liquid guiding groove. The at least one first liquid guiding groove is communicated between the liquid storage container and the accommodating space. A side wall of the bushing has at least one second liquid guiding groove. The bushing moves upward or downward in the accommodating space, so that the at least one first liquid guiding groove and the at least one second liquid guiding groove are connected or disconnected. The atomizing assembly is mounted under the liquid containing module. The atomizing assembly is equipped with an atomizing core module. The atomizing core module is assembled in the bushing. A side wall of the atomizing core module has at least one third liquid guiding groove. The atomizing core module and the bushing move upward or downward in the accommodating space to make the at least one second liquid guiding groove and the at least one third liquid guiding groove move upward or downward. The at least one second liquid guiding groove and the at least one third liquid guiding groove are aligned with or misaligned with the at least one first liquid guiding groove. The at least one second liquid guiding groove and the at least one third liquid guiding groove are connected with or disconnected from the at least one first liquid guiding groove. The rod element is mounted under the atomizing assembly.

As described above, the liquid storage container and the atomizing core module of the atomizing device are connected with each other or separated from each other by virtue of the bushing moving upward or downward in the accommodating space, in this way, the liquid containing module and the atomizing assembly become independent components, and the liquid containing module and the atomizing assembly are more convenient in a transportation, an assembly, a replacement and a use. Simultaneously, because the rod element and the atomizing assembly of the atomizing device have a detachability, a dry burning condition of the atomizing core module is further prevented from being happened. As a result, the atomizing device is capable of controlling a connection or a separation between the liquid storage container and the atomizing core module.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
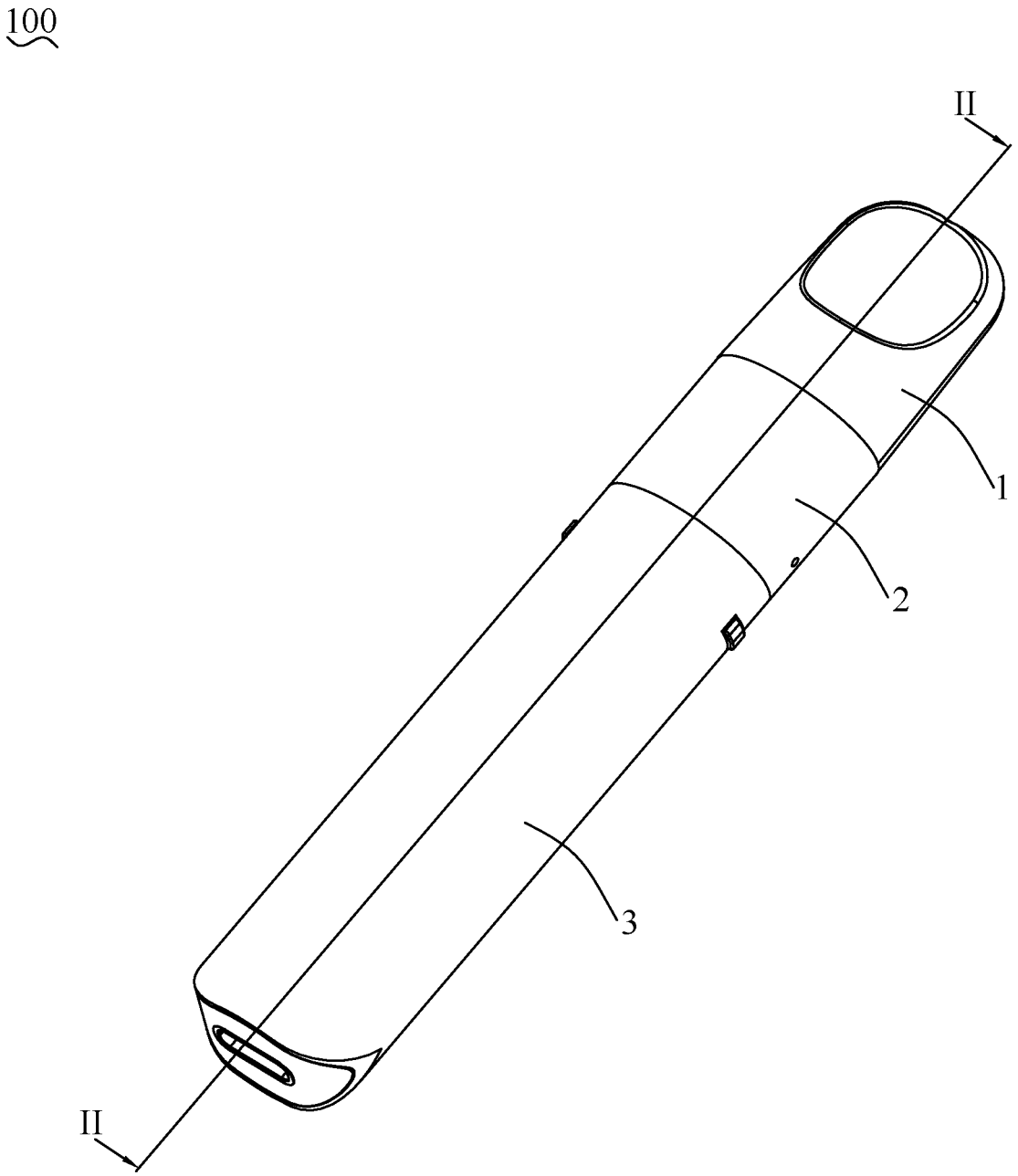
FIG. 1 is a perspective view of an atomizing device in accordance with the present invention.
Figure 2:
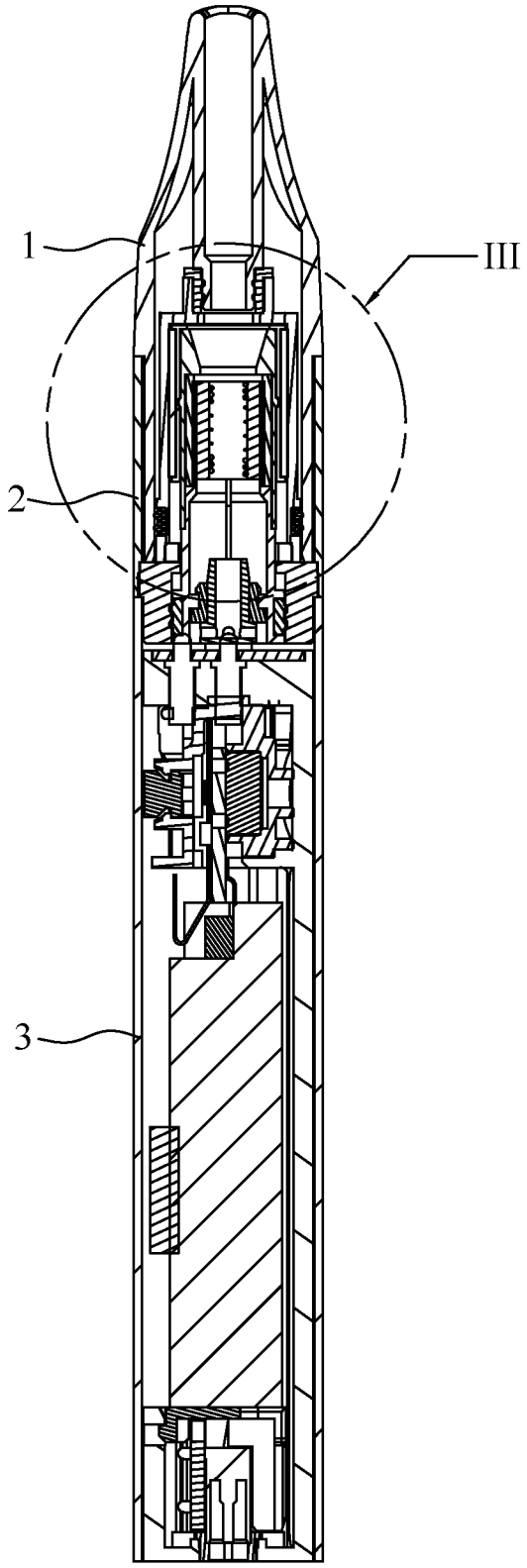
FIG. 2 is a cross-sectional view of the atomizing device along a line II-II of FIG. 1.
Figure 3:
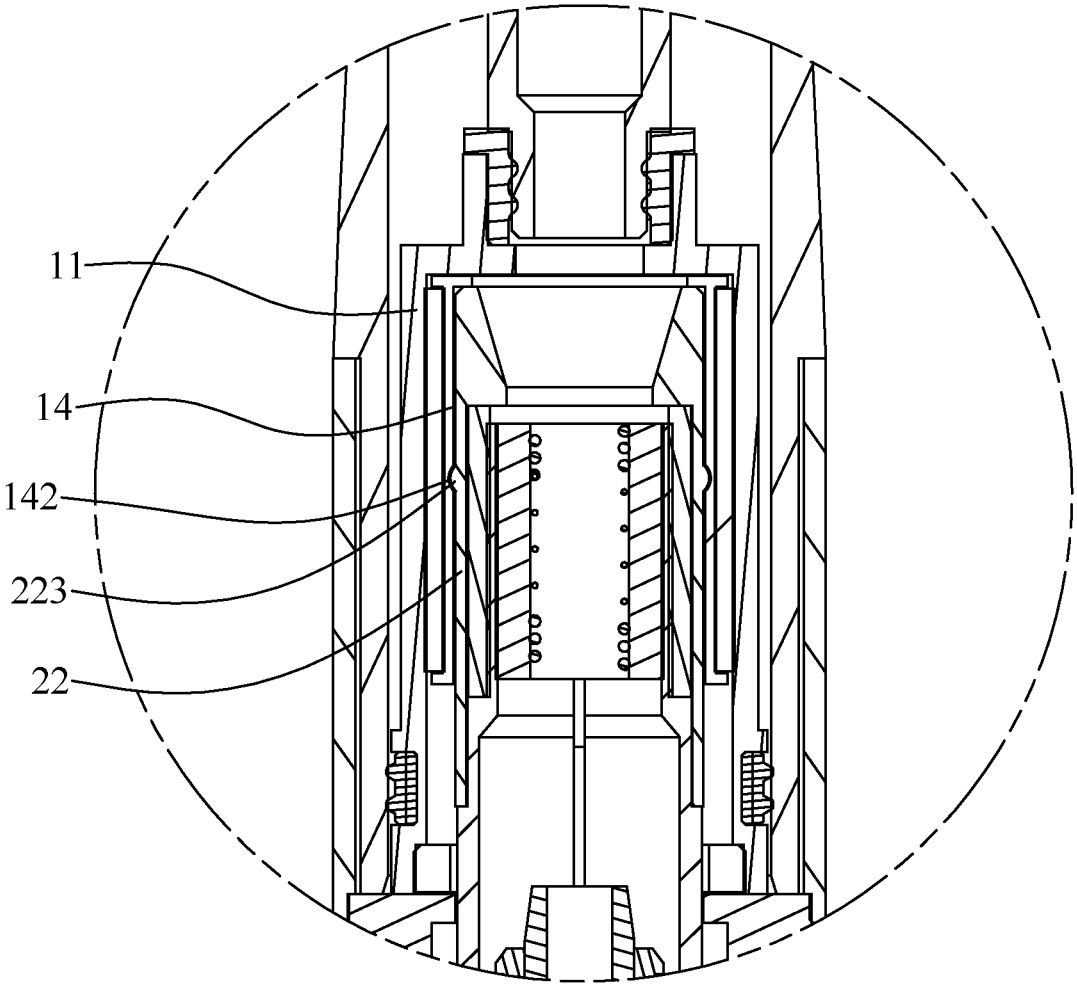
FIG. 3 is an enlarged view of an encircled portion III of the atomizing device of FIG. 2.
Figure 4:
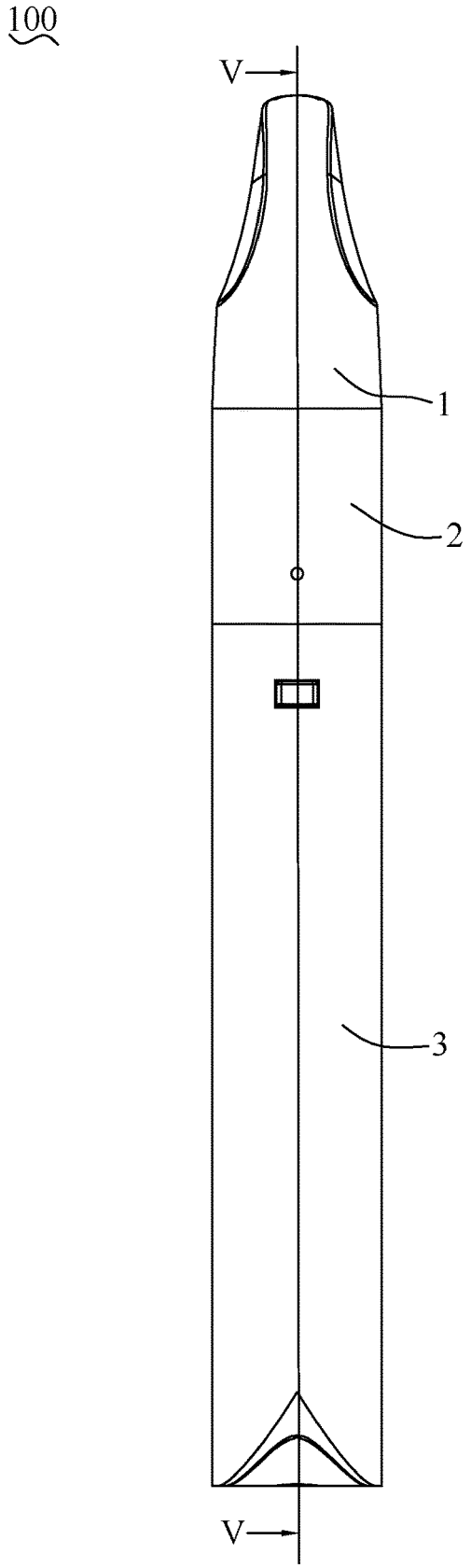
FIG. 4 is a side view of the atomizing device in accordance with the present invention.
Figure 5:
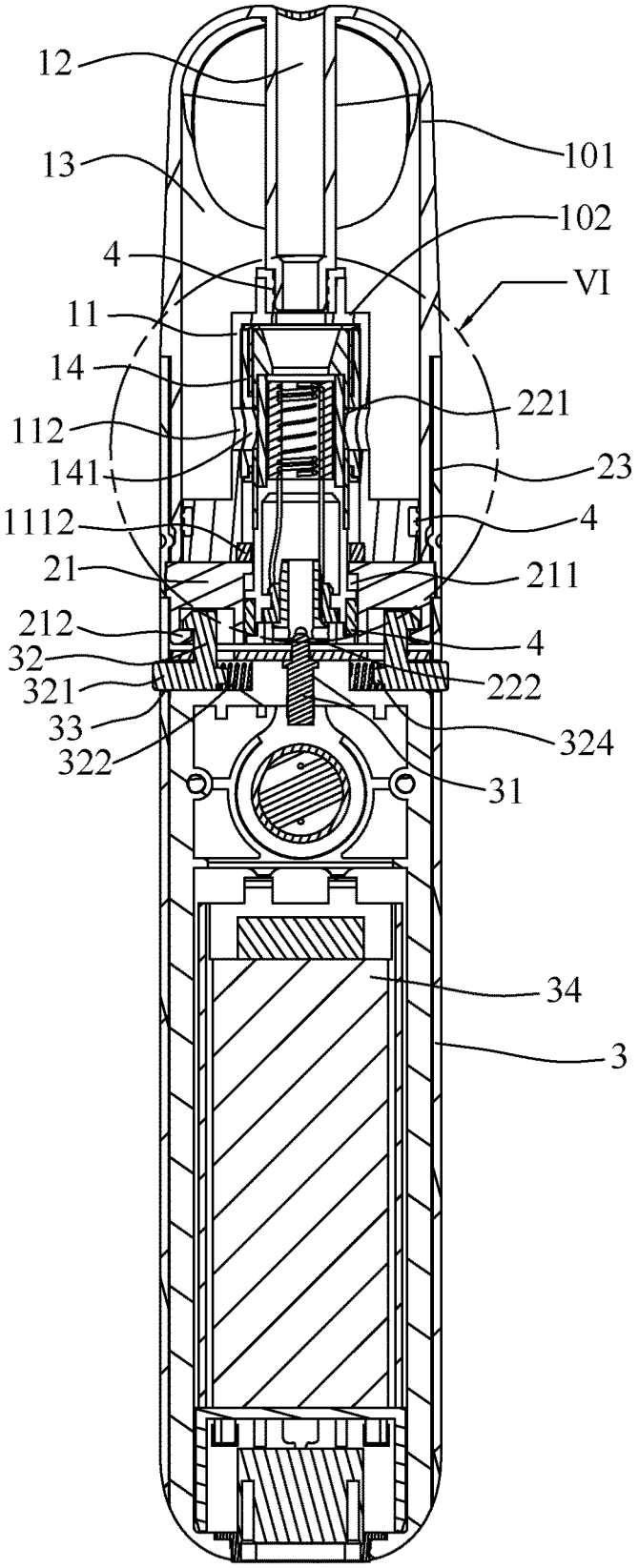
FIG. 5 is a cross-sectional view of the atomizing device along a line V-V of FIG. 4.

With reference to FIG. 1 and FIG. 5, an atomizing device 100 in accordance with the present invention is shown. The atomizing device 100 includes a liquid containing module 1, an atomizing assembly 2 and a rod element 3. The liquid containing module 1 is mounted on the atomizing assembly 2, and the rod element 3 is mounted under the atomizing assembly 2. The liquid containing module 1, the atomizing assembly 2 and the rod element 3 are disassembled and assembled separately. The atomizing device 100 has a detachability. The atomizing assembly 2 is changeable. The atomizing device 100 is changeable.

With reference to FIG. 5 to FIG. 9, an inside of the liquid containing module 1 has a hollow fixing element 11 and a liquid storage container 13. A middle of the inside of the liquid containing module 1 has a flowing channel 12 penetrating through a top of the liquid containing module 1 and extending downward. The flowing channel 12 is located to a top of the fixing element 11. The flowing channel 12 is communicated with the top of the fixing element 11. A peripheral wall of the flowing channel 12 and the fixing element 11 are spaced from an inner surface of an outer wall of the liquid containing module 1 to form the liquid storage container 13. The liquid storage container 13 surrounds the peripheral wall of the flowing channel 12 and an outer surface of the fixing element 11.

A middle of an inside of the fixing element 11 has an accommodating space 111. The accommodating space 111 penetrates through the top of the fixing element 11 and a bottom of the fixing element 11. A side wall of the accommodating space 111 has at least one first liquid guiding groove 112. The liquid storage container 13, the at least one first liquid guiding groove 112 and the accommodating space 111 are communicated. A bottom of the accommodating space 111 has an opening 1111. The opening 1111 is communicated between the accommodating space 111 and the at least one first liquid guiding groove 112. An inner periphery wall of the opening 1111 extends inward to form a limiting portion 1112. Specifically, two sides of the inner periphery wall of the opening 1111 extend inward to form two limiting portions 1112. Two sides of the side wall of the accommodating space 111 have two first liquid guiding grooves 112.

The liquid containing module 1 has an outer surrounding wall 101 and an inner surrounding wall 102. The outer surrounding wall 101 surrounds the inner surrounding wall 102. The outer surrounding wall 101 is spaced from the inner surrounding wall 102. The liquid storage container 13 is formed between the outer surrounding wall 101 and the inner surrounding wall 102. The flowing channel 12 is surrounded by a top portion of the inner surrounding wall 102, and the accommodating space 111 is surrounded by a bottom portion of the inner surrounding wall 102 and is communicated with the flowing channel 12. The bottom portion of the inner surrounding wall 102 has the at least one first liquid guiding groove 112. The at least one first liquid guiding groove 112 is communicated between the liquid storage container 13 and the accommodating space 111.

An inside of the accommodating space 111 is equipped with a bushing 14. The two limiting portions 1112 block a bottom of the bushing 14. The two limiting portions 1112 limit the bushing 14 in the accommodating space 111. A side wall of the bushing 14 has at least one second liquid guiding groove 141. The bushing 14 moves upward or downward in the accommodating space 111, so that the at least one first liquid guiding groove 112 and the second liquid guiding groove 141 are connected or disconnected. When the bushing 14 moves upward or downward in the accommodating space 111, the limiting portion 1112 limits the bushing 14 in the accommodating space 111. Specifically, two sides of the side wall of the bushing 14 have two second liquid guiding grooves 141. The two second liquid guiding grooves 141 are communicated with the two first liquid guiding grooves 112. The bushing 14 moves upward or downward along an axis direction, so that the two first liquid guiding grooves 112 and the two second liquid guiding grooves 141 are connected or disconnected.

Specifically, when the bushing 14 is located at the bottom of the accommodating space 111, the two second liquid guiding grooves 141 are disconnected from the two first liquid guiding grooves 112, so that the two first liquid guiding grooves 112 are blocked by the side wall of the bushing 14, and the liquid storage container 13 is separated from the accommodating space 111. When the bushing 14 moves upward to align the two second liquid guiding grooves 141 with the two first liquid guiding grooves 112, the liquid storage container 13 and the accommodating space 111 are connected.

The atomizing assembly 2 is mounted under the liquid containing module 1. The atomizing assembly 2 is made of aluminum. A bottom of the atomizing assembly 2 is equipped with a combining portion 21 and an atomizing core module 22. The combining portion 21 has a fixing space 211 penetrating through a top and a bottom of the combining portion 21. A bottom of the atomizing core module 22 is assembled in the fixing space 211. Two sides of an upper portion of an inner surface of the fixing space 211 protrude face to face to form two stopping portions 213.

The atomizing core module 22 includes an outer tube 224, an inner tube 225, a non-woven material 226 and a heating unit 227. The heating unit 227 is mounted in the outer tube 224 and the inner tube 225. The outer tube 224 is mounted to a top of the inner tube 225. The non-woven material 226 is mounted in the outer tube 224, and the outer tube 224 surrounds the heating unit 227. Two lower portions of two sides of the atomizing core module 22 protrude oppositely to form two stepping portions 228. Two sides of a lower portion of the inner tube 225 protrude oppositely to form the two stepping portions 228. The two stepping portions 228 move upward along a distance D1 to bottoms of the two stopping portions 213. A side wall of the atomizing core module 22 has at least one third liquid guiding groove 221. The atomizing core module 22 is assembled in the bushing 14. The atomizing core module 22 and the bushing 14 move upward or downward in the accommodating space 111 to make the at least one second liquid guiding groove 141 and the at least one third liquid guiding groove 221 move upward or downward, the at least one second liquid guiding groove 141 and the at least one third liquid guiding groove 221 are aligned with or misaligned with the at least one first liquid guiding groove 112, so the at least one second liquid guiding groove 141 and the at least one third liquid guiding groove 221 are connected with or disconnected from the at least one first liquid guiding groove 112.

Two sides of the side wall of the atomizing core module 22 have two third liquid guiding grooves 221. Two sides of the outer tube 224 define the two third liquid guiding grooves 221. The non-woven material 226 is mounted between the heating unit 227 and the two third liquid guiding grooves 221. The two third liquid guiding grooves 221 are communicated with the two second liquid guiding grooves 141. The atomizing core module 22 is spaced from a peripheral wall of the atomizing assembly 2 to form an assembly space 23. A bottom of the atomizing core module 22 is equipped with a first conductive element 222. The first conductive element 222 is exposed out of the atomizing assembly 2.

Figure 6:
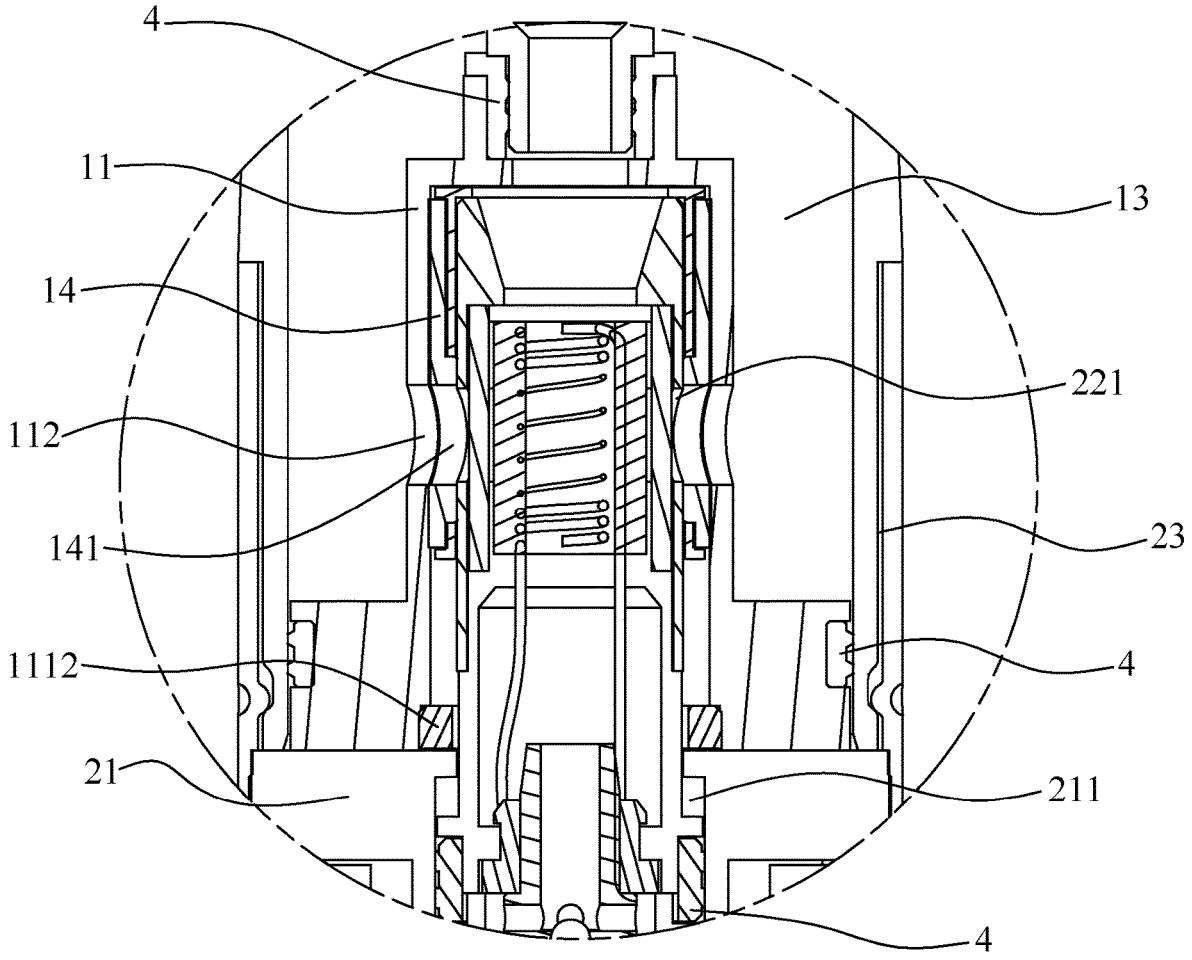
FIG. 6 is an enlarged view of an encircled portion VI of the atomizing device of FIG. 5.
Figure 7:
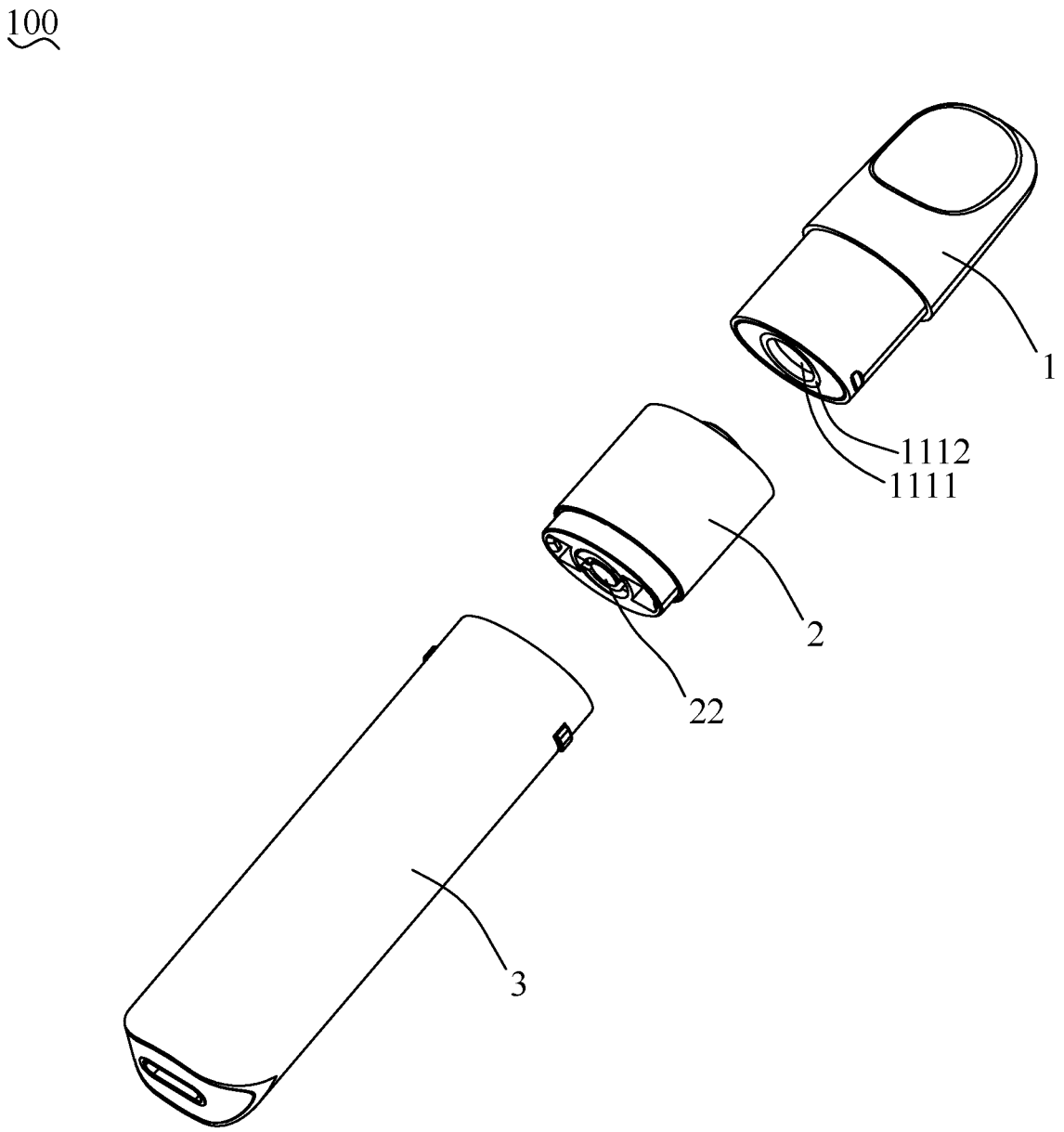
FIG. 7 is an exploded view of the atomizing device in accordance with the present invention.
Figure 8:
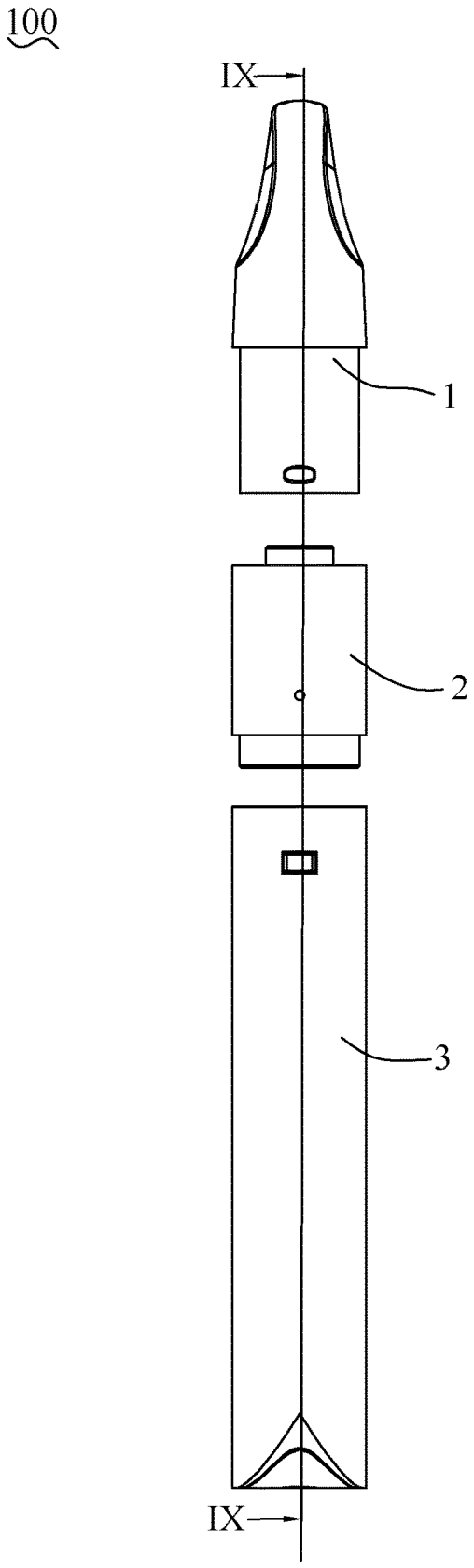
FIG. 8 is another exploded view of the atomizing device in accordance with the present invention.
Figure 9:
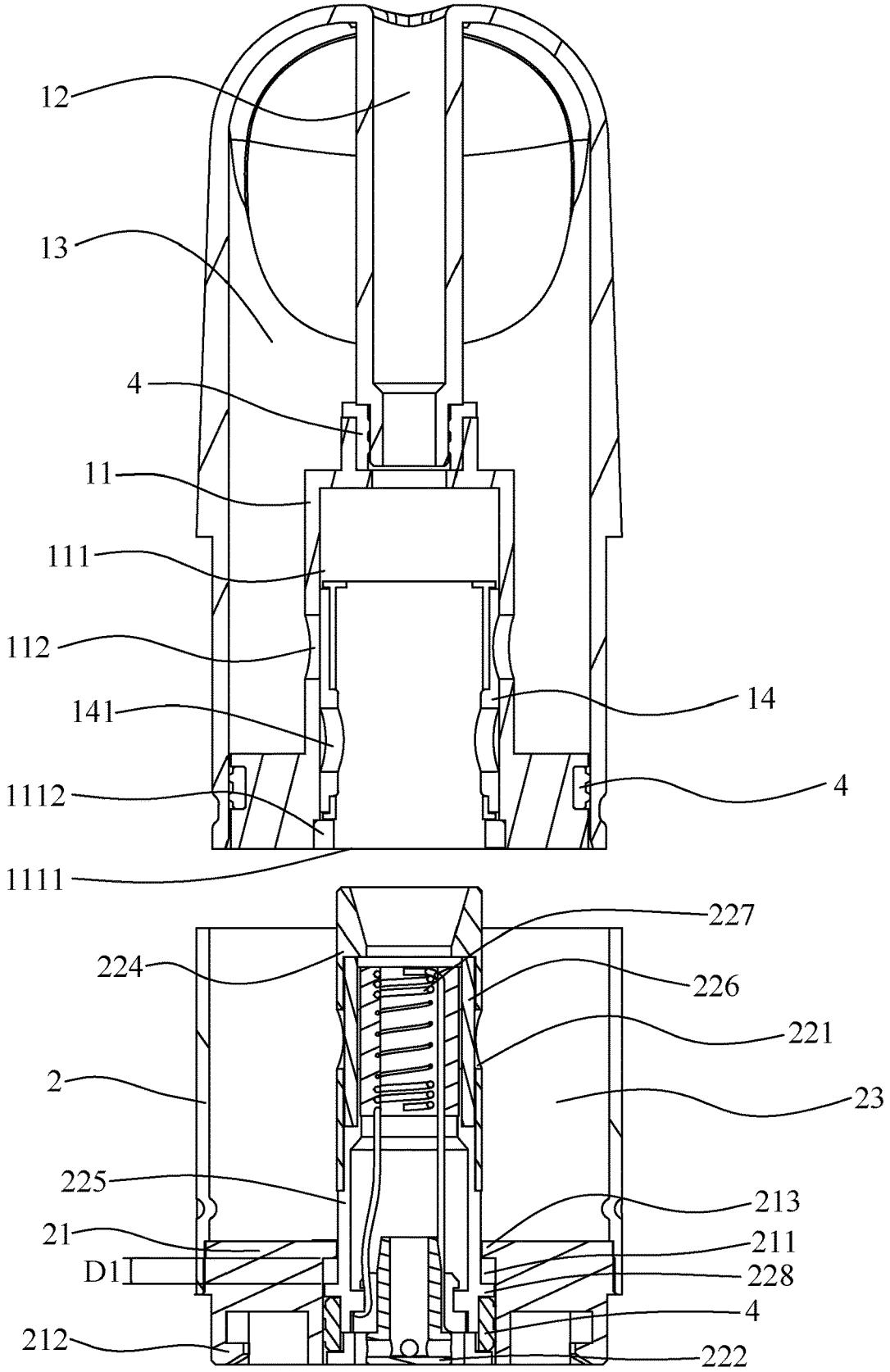
FIG. 9 is a cross-sectional view of a part of the atomizing device along a line IX-IX of FIG. 8.
Figure 10:
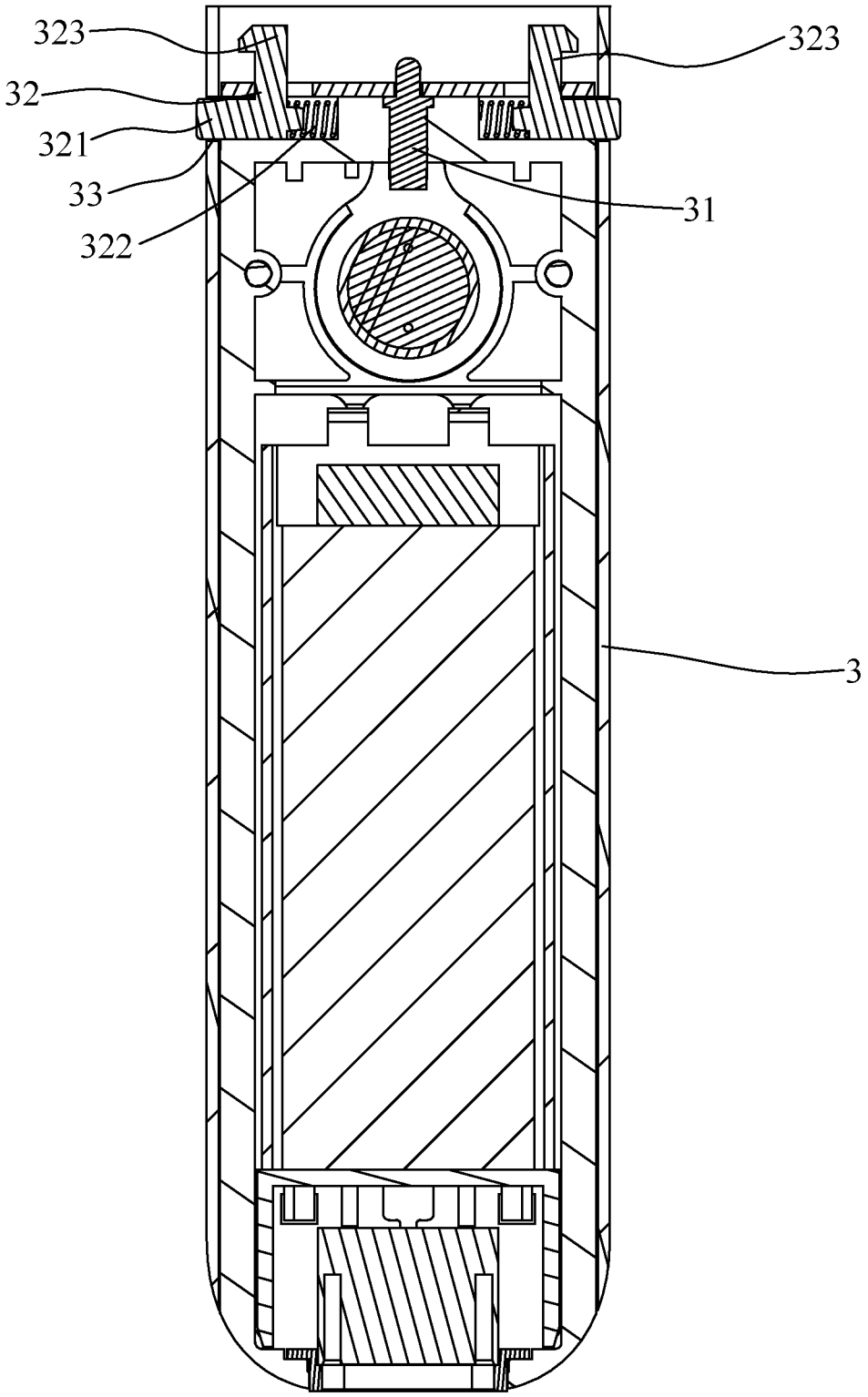
FIG. 10 is a cross-sectional view of the other part of the atomizing device along the line IX-IX of FIG. 8.
Figure 11:
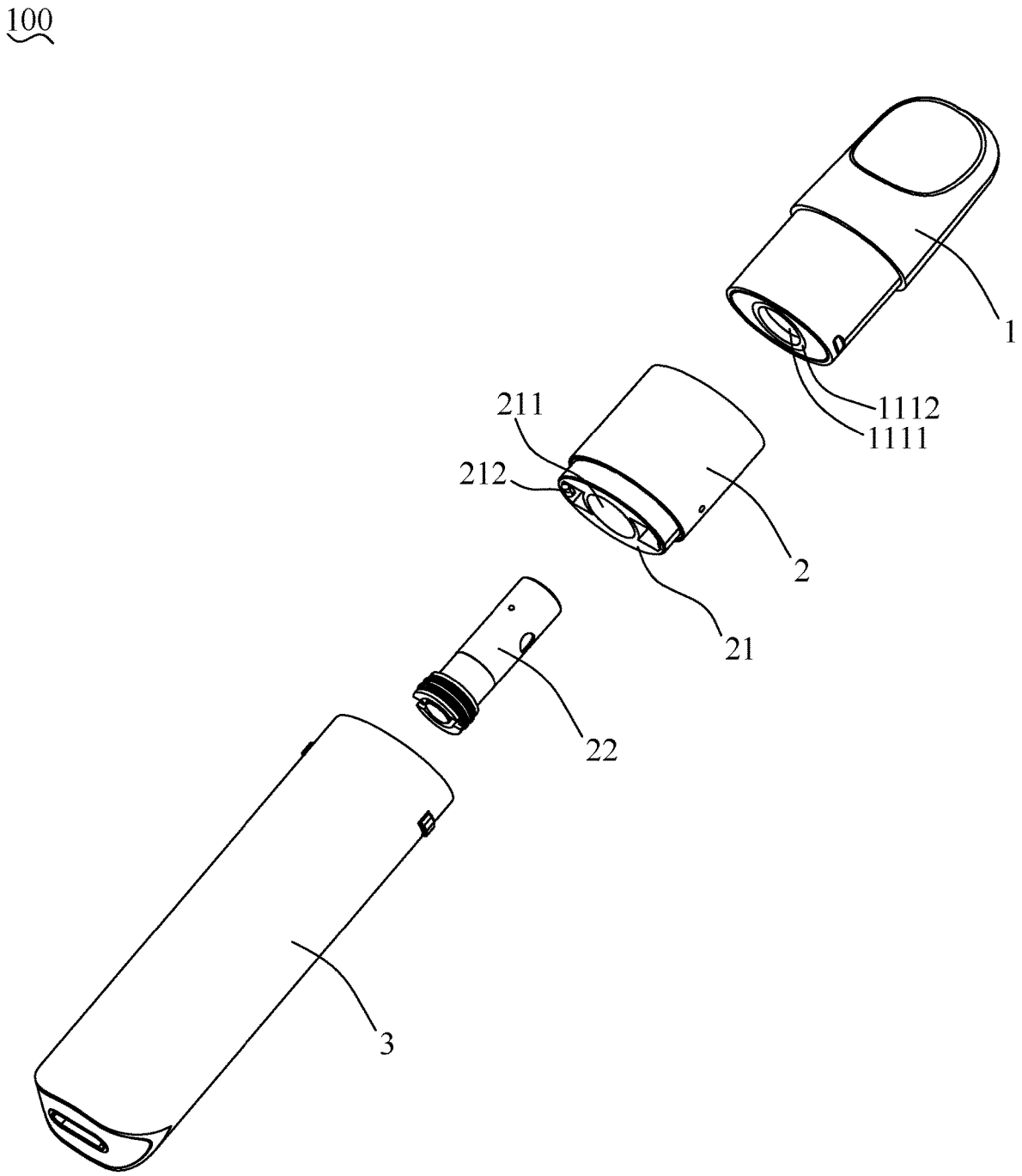
FIG. 11 is an exploded view of the atomizing device, wherein an atomizing assembly is separated from an atomizing core module of the atomizing device in accordance with the present invention.
Figure 12:
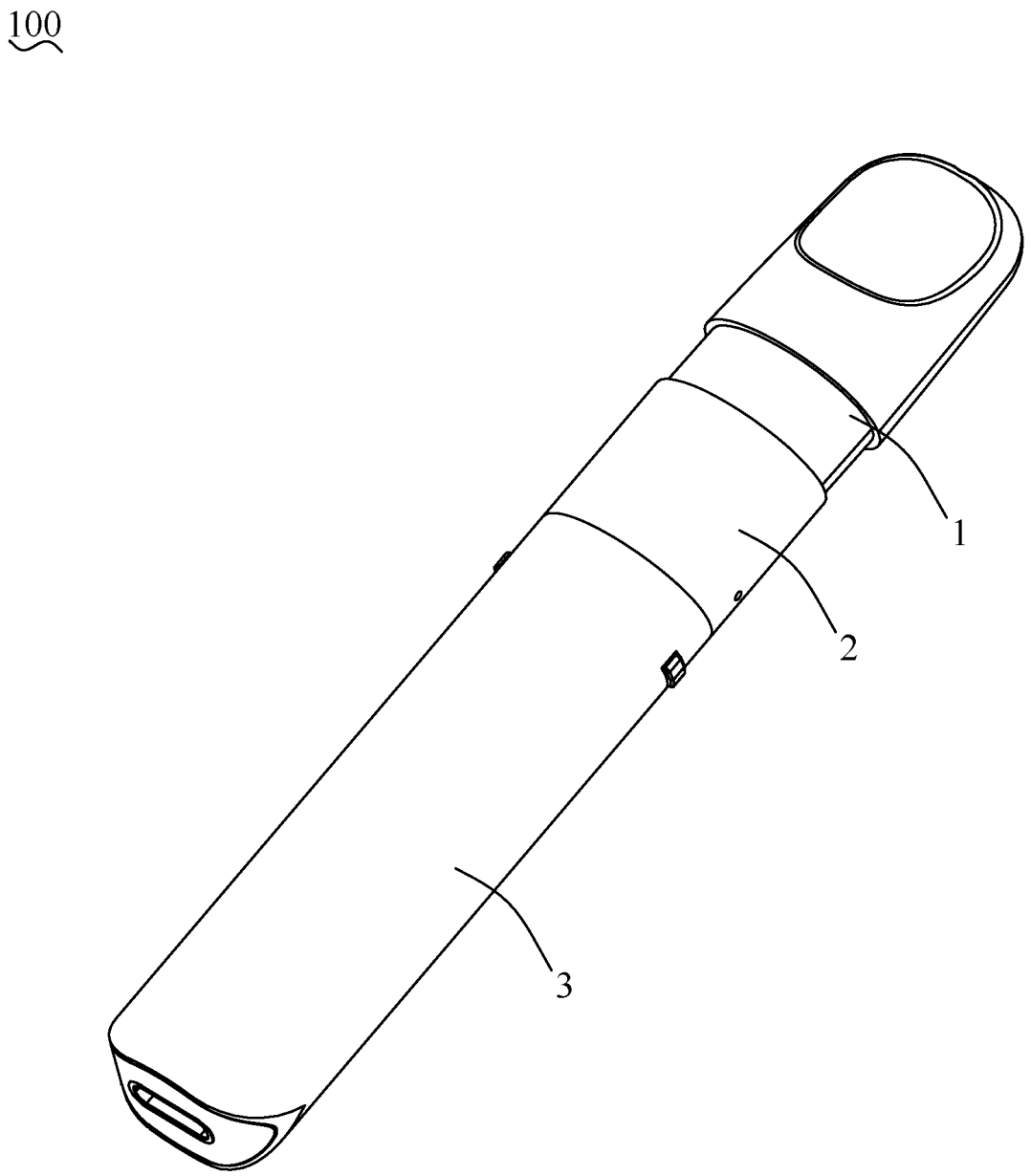
FIG. 12 is an assembled view of the atomizing device, wherein a liquid storage container is without being fully assembled into the atomizing assembly of the atomizing device in accordance with the present invention.
Figure 13:
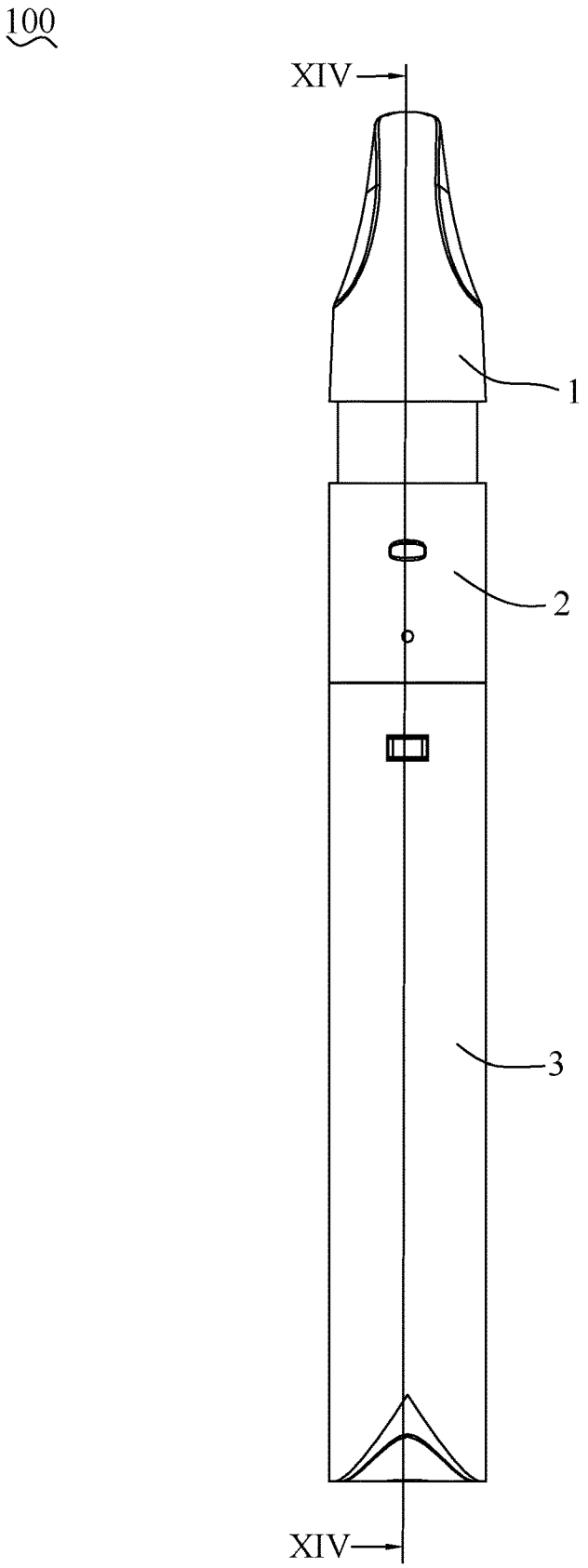
FIG. 13 is a lateral view of the atomizing device in accordance with the present invention.
Figure 14:
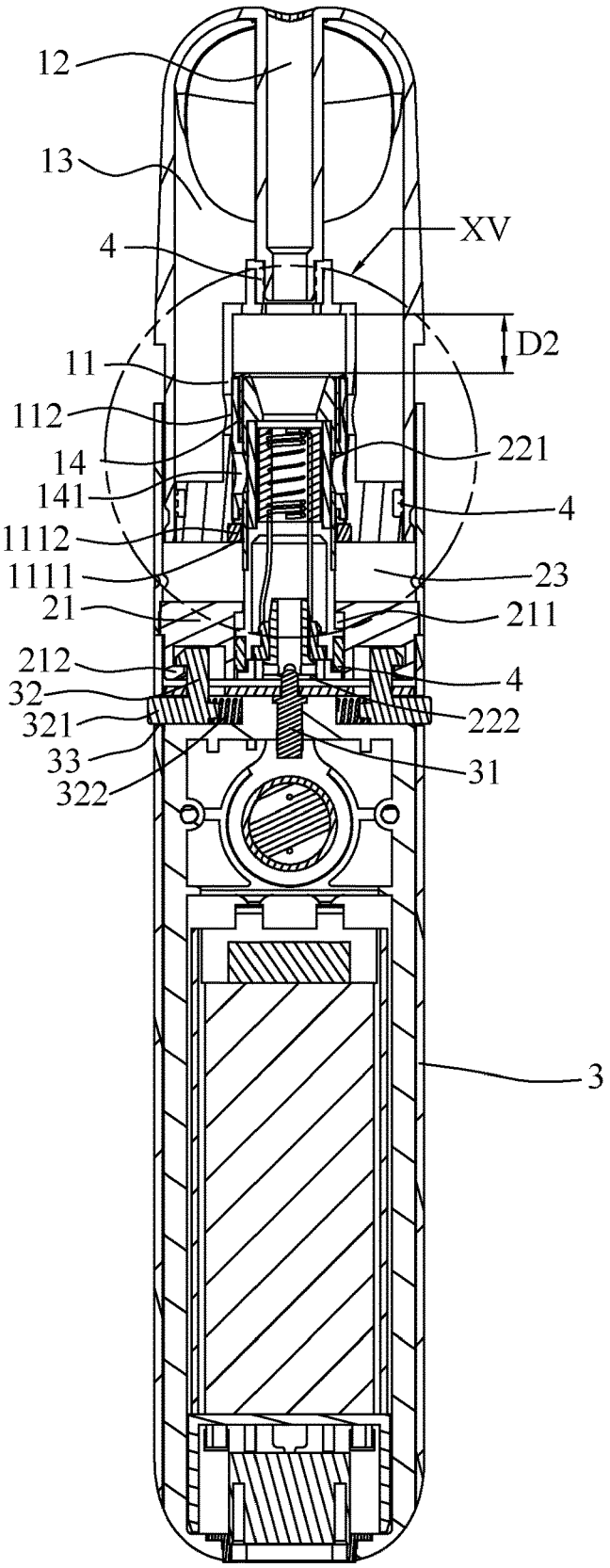
FIG. 14 is a cross-sectional view of the atomizing device along a line XIV-XIV of FIG. 13.
Figure 15:
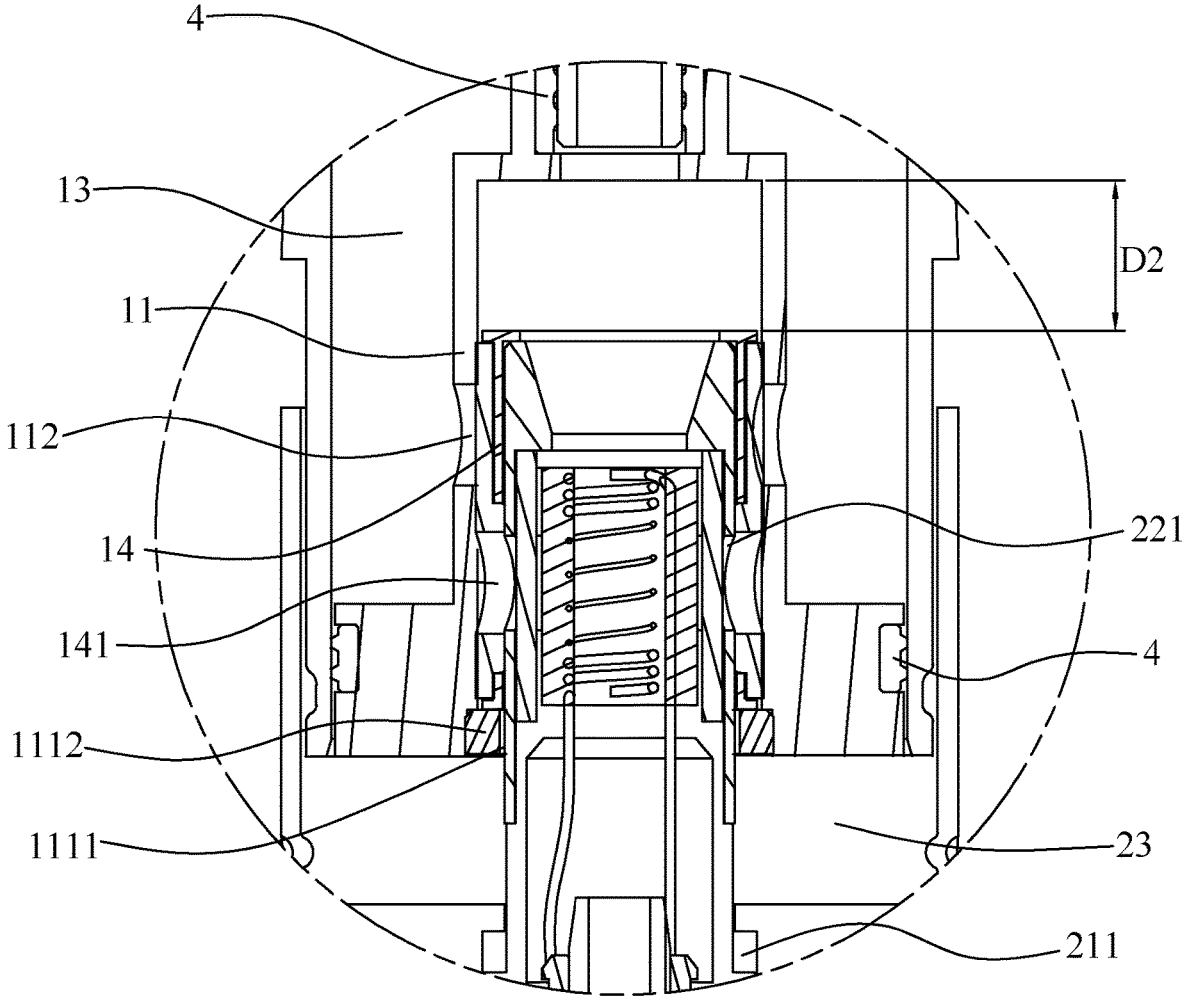
FIG. 15 is an enlarged view of an encircled portion XV of the atomizing device of FIG. 14.

With reference to FIG. 5 to FIG. 7, after the atomizing device 100 is used for a period of time, the user is able to pull out the atomizing core module 22 from the fixing space 211 of the combining portion 21, and the user is able to assemble the new atomizing core module 22 into the fixing space 211. In this way, a usage status of the atomizing device 100 is maintained by virtue of changing the atomizing core module 22.

With reference to FIG. 5 to FIG. 7, a middle of an upper portion of an inside of the rod element 3 is equipped with a second conductive element 31. The rod element 3 includes a battery module 34 located under the second conductive element 31. The second conductive element 31 is disposed corresponding to the first conductive element 222. The first conductive element 222 moves downward or upward along a vertical route, the second conductive element 31 is in contact with or is disconnected from the first conductive element 222. The second conductive element 31 is in contact with the battery module 34 of the rod element 3. When the second conductive element 31 is in contact with the first conductive element 222, electric power of the battery module 34 is transmitted to the first conductive element 222 through the second conductive element 31, and the electric power is further supplied for the atomizing core module 22.

At least one side of the bottom of the combining portion 21 of the atomizing assembly 2 protrudes downward and then protrudes inward to form at least one buckling portion 212. At least one side of the upper portion of the inside of the rod element 3 is equipped with at least one buckling element 32. The at least one buckling element 32 is corresponding to the at least one buckling portion 212. The at least one buckling element 32 and the at least one buckling portion 212 are buckled with each other to fasten the atomizing assembly 2 with the rod element 3. Specifically, two sides of the bottom of the combining portion 21 protrude downward and then protrude towards each other to form two buckling portions 212. Two sides of the upper portion of the inside of the rod element 3 are equipped with two buckling elements 32. The two buckling elements 32 are buckled with the two buckling portions 212.

The rod element 3 has at least one pressing perforation 33. A lower portion of one side of the at least one buckling element 32 protrudes outwardly to form a pressing portion 321. A lower portion of the other side of the at least one buckling element 32 protrudes inward and opposite to the pressing portion 321 to form a fixing pillar 324. A top of the pressing portion 321 protrudes upward and then protrudes outward to form a hooking portion 323. One side of the pressing portion 321 projects outward from the at least one pressing perforation 33. The fixing pillar 324 of the at least one buckling element 32 is worn by an elastic element 322.

When the atomizing assembly 2 is assembled to the rod element 3, the at least one buckling element 32 and the at least one buckling portion 212 are buckled with each other, the atomizing assembly 2 is engaged with the rod element 3. The hooking portion 323 of the at least one buckling element 32 hooks a tail end of the at least one buckling portion 212. When the atomizing assembly 2 is to be apart away from the rod element 3, the pressing portion 321 of the at least one buckling element 32 is pressed inward, the at least one buckling element 32 moves inward, at the moment, the elastic element 322 is compressed, the buckling element 32 and the buckling portion 212 are loosened from each other, and the buckling element 32 breaks away from the buckling portion 212, the hooking portion 323 of the at least one buckling element 32 breaks away from the tail end of the at least one buckling portion 212, so that the rod element 3 and the atomizing assembly 2 are separated. Then the pressing portion 321 of the at least one buckling element 32 is released, and the elastic element 322 is released, a resilience force of the elastic element 322 restores the buckling element 32 to an initial position.

Specifically, two sides of the rod element 3 have two pressing perforations 33. A lower portion of one side of each buckling element 32 protrudes outwardly to form the pressing portion 321. A lower portion of the other side of each buckling element 32 protrudes inward and opposite to the pressing portion 321 to form the fixing pillar 324. A top of the pressing portion 321 protrudes upward and then protrudes outward to form the hooking portion 323. One side of the pressing portion 321 projects outward from one pressing perforation 33. The fixing pillar 324 of each buckling element 32 is worn by the elastic element 322.

When the atomizing assembly 2 is assembled to the rod element 3, the two buckling elements 32 and the two buckling portions 212 are buckled with each other, the atomizing assembly 2 is engaged with the rod element 3. When the atomizing assembly 2 is to be apart away from the rod element 3, the pressing portion 321 of each buckling element 32 is pressed inward, each buckling element 32 moves inward, at the moment, the elastic element 322 is compressed, the two buckling elements 32 and the two buckling portions 212 are loosened from each other, and the two buckling elements 32 break away from the two buckling portions 212, so that the rod element 3 and the atomizing assembly 2 are separated. Then the pressing portion 321 of each buckling element 32 is released, and the elastic element 322 is released, the resilience force of the elastic element 322 restores each buckling element 32 to the initial position.

The atomizing device 100 further has at least one sealing element 4. The at least one sealing element 4 is assembled at junctions among components of the atomizing device 100. The at least one sealing element 4 is assembled at a junction between the fixing element 11 and the flowing channel 12, a junction between the fixing element 11 and the inner surface of the outer wall of the liquid containing module 1, and a junction between the combining portion 21 and the atomizing core module 22. The components of the atomizing device 100 include the liquid containing module 1, the atomizing assembly 2 and the rod element 3. The at least one sealing element 4 is without being limited to the junction between the fixing element 11 and the flowing channel 12, the junction between the fixing element 11 and the inner surface of the outer wall of the liquid containing module 1, the junction between the combining portion 21 and the atomizing core module 22, etc. The sealing element 4 is made of silicone.

With reference to FIG. 4 to FIG. 7, when the liquid containing module 1 is separated from the atomizing assembly 2, the bushing 14 is located at the bottom of the accommodating space 111, the two second liquid guiding grooves 141 are disconnected from the two first liquid guiding grooves 112 to make the two second liquid guiding grooves 141 blocked by two sides of a peripheral wall of the fixing element 11 and the two first liquid guiding grooves 112 blocked by the side wall of the bushing 14, so that the accommodating space 111 is isolated from the liquid storage container 13 for preventing liquid leaking from the liquid storage container 13. The liquid is able to be an oil sub stance.

With reference to FIG. 1 to FIG. 15, a top of the atomizing core module 22 is movably mounted in the bushing 14 along an up-down direction. The atomizing core module 22 and the bushing 14 move upward or downward. When the atomizing core module 22 and the bushing 14 move upward to the top of the fixing element 11 along a distance D2, the atomizing core module 22 and the bushing 14 are blocked by the top of the fixing element 11, the at least one first liquid guiding groove 112, the at least one second liquid guiding groove 141 and the at least one third liquid guiding groove 221 are aligned, and the at least one first liquid guiding groove 112, the at least one second liquid guiding groove 141 and the at least one third liquid guiding groove 221 are connected, so that the liquid containing module 1 is located at an opened status. When the atomizing core module 22 and the bushing 14 move downward to the bottom of the fixing element 11, the at least one first liquid guiding groove 112, the at least one second liquid guiding groove 141 and the at least one third liquid guiding groove 221 are misaligned, and the at least one first liquid guiding groove 112, the at least one second liquid guiding groove 141 and the at least one third liquid guiding groove 221 are disconnected, so that the liquid containing module 1 is located at a closed status.

With reference to FIG. 1 to FIG. 15, the top of the atomizing core module 22 is movably mounted in the bushing 14 along the up-down direction. The atomizing core module 22 and the bushing 14 move upward or downward. When the atomizing core module 22 and the bushing 14 move upward to the top of the fixing element 11 along the distance D2, the atomizing core module 22 and the bushing 14 are blocked by the top of the fixing element 11, the two first liquid guiding grooves 112, the two second liquid guiding grooves 141 and the two third liquid guiding grooves 221 are aligned, and the two first liquid guiding grooves 112, the two second liquid guiding grooves 141 and the two third liquid guiding grooves 221 are connected, so that the liquid containing module 1 is located at the opened status. When the atomizing core module 22 and the bushing 14 move downward to the bottom of the fixing element 11, the two first liquid guiding grooves 112, the two second liquid guiding grooves 141 and the two third liquid guiding grooves 221 are misaligned, and the two first liquid guiding grooves 112, the two second liquid guiding grooves 141 and the two third liquid guiding grooves 221 are disconnected, so that the liquid containing module 1 is located at the closed status.

The side wall of the bushing 14 further has at least one locating groove 142 recessed inward. An outer surface of the side wall of the atomizing core module 22 protrudes outward to form at least one locating portion 223. The at least one locating portion 223 is disposed corresponding to the at least one locating groove 142. When the at least one locating portion 223 is assembled to the at least one locating groove 142, the side wall of the atomizing core module 22 is fastened with the bushing 14. Specifically, two portions of an inner surface of the side wall of the bushing 14 are recessed away from the atomizing core module 22 to form two locating grooves 142. Two portions of an outer surface of the side wall of the atomizing core module 22 protrude outward to form two locating portions 223. The two locating portions 223 are disposed corresponding to the two locating grooves 142. The two locating portions 223 are located in the two locating grooves 142.

With reference to FIG. 1 to FIG. 15, when the liquid containing module 1 is combined with the atomizing assembly 2, the top of the atomizing core module 22 of the atomizing assembly 2 enters the bushing 14 of the liquid containing module 1, and a bottom of the liquid containing module 1 enters the assembly space 23, the liquid storage container 13 is without being fully assembled into the assembly space 23 of the atomizing assembly 2, so the liquid containing module 1 is combined with the atomizing assembly 2. The bottom of the liquid containing module 1 slides upward or downward in the assembly space 23.

When the top of the atomizing core module 22 of the atomizing assembly 2 continuously enters the bushing 14 in the accommodating space 111, the bottom of the liquid containing module 1 continuously enter the assembly space 23, the outer surface of the side wall of the atomizing core module 22 rubs against the inner surface of the side wall of the bushing 14, the atomizing core module 22 pushes the bushing 14 upward. At the same time, the two third liquid guiding grooves 221 of the atomizing core module 22 are aligned with the two second liquid guiding grooves 141 of the bushing 14, and the two third liquid guiding grooves 221 of the atomizing core module 22 are connected with the two second liquid guiding grooves 141 of the bushing 14, the atomizing core module 22 and the bushing 14 move upward to make the two second liquid guiding grooves 141 and the two third liquid guiding grooves 221 move upward, the two second liquid guiding grooves 141 and the two third liquid guiding grooves 221 are aligned with the two first liquid guiding grooves 112, so that the two second liquid guiding grooves 141 and the two third liquid guiding grooves 221 are connected with the two first liquid guiding grooves 112, the liquid in the liquid storage container 13 is able to enter the atomizing core module 22, the atomizing core module 22 heats the liquid for atomizing the liquid. The bottom of the liquid containing module 1 abuts against the combining portion 21.

With reference to FIG. 3 to FIG. 15, when the user finishes using the atomizing device 100, the user pulls the liquid containing module 1 upward. At the same time, the fixing element 11 moves upward with the liquid containing module 1, and the bushing 14 is kept at a current position, so the two first liquid guiding grooves 112 of the fixing element 11 are gradually disconnected from the two second liquid guiding grooves 141 of the bushing 14, correspondingly, the liquid in the liquid storage container 13 is isolated from the atomizing core module 22.

When the user further separates the rod element 3 from the atomizing assembly 2 by loosening the two buckling elements 32 from the two buckling portions 212, namely, the second conductive element 31 is disconnected from the first conductive element 222, so that when the atomizing device 100 is unused by the user, the atomizing core module 22 is without an electricity, and a dry burning condition of the atomizing core module 22 is prevented.

As described above, the liquid storage container 13 and the atomizing core module 22 of the atomizing device 100 are connected with each other or separated from each other by virtue of the bushing 14 moving upward or downward in the accommodating space 111, in this way, the liquid containing module 1 and the atomizing assembly 2 become independent components, and the liquid containing module 1 and the atomizing assembly 2 are more convenient in a transportation, an assembly, a replacement and a use. Simultaneously, because the rod element 3 and the atomizing assembly 2 of the atomizing device 100 have a detachability, the dry burning condition of the atomizing core module 22 is further prevented from being happened. As a result, the atomizing device 100 is capable of controlling a connection or a separation between the liquid storage container 13 and the atomizing core module 22.

What is claimed is:

1. An atomizing device, comprising:

a liquid containing module, an inside of the liquid containing module having a fixing element and a liquid storage container, a middle of an inside of the liquid containing module having a flowing channel penetrating through a top of the liquid containing module and extending downward, the flowing channel being communicated with a top of the fixing element, the liquid storage container surrounding a peripheral wall of the flowing channel and an outer surface of the fixing element, the fixing element having an accommodating space penetrating through the top of the fixing element and a bottom of the fixing element, a side wall of the accommodating space having at least one first liquid guiding groove, a bottom of the accommodating space having an opening, the opening being communicated between the accommodating space and the at least one first liquid guiding groove, an inside of the accommodating space being equipped with a bushing, a side wall of the bushing having at least one second liquid guiding groove, the bushing moving upward or downward in the accommodating space, the bushing moving upward or downward along an axis direction, so that the at least one first liquid guiding groove and the at least one second liquid guiding groove being connected or disconnected; and an atomizing assembly mounted under the liquid containing module, the atomizing assembly being equipped with an atomizing core module, the atomizing core module being assembled in the bushing, a side wall of the atomizing core module having at least one third liquid guiding groove, the atomizing core module and the bushing moving upward or downward in the accommodating space to make the at least one second liquid guiding groove and the at least one third liquid guiding groove move upward or downward, the at least one second liquid guiding groove and the at least one third liquid guiding groove being aligned with or misaligned with the at least one first liquid guiding groove, the at least one second liquid guiding groove and the at least one third liquid guiding groove being connected with or disconnected from the at least one first liquid guiding groove.

2. The atomizing device as claimed in claim 1, further comprising a rod element, the rod element being mounted under the atomizing assembly.

3. The atomizing device as claimed in claim 2, wherein a bottom of the atomizing core module is equipped with a first conductive element, a top of the rod element is equipped with a second conductive element, the rod element includes a battery module, the second conductive element is disposed corresponding to the first conductive element.

4. The atomizing device as claimed in claim 3, wherein the first conductive element moves downward or upward along a vertical route, the second conductive element is in contact with or is disconnected from the first conductive element.

5. The atomizing device as claimed in claim 1, wherein an inner periphery wall of the opening extends inward to form a limiting portion, when the bushing moves upward or downward in the accommodating space, the limiting portion limits the bushing in the accommodating space.

6. The atomizing device as claimed in claim 1, wherein the side wall of the bushing further has at least one locating groove recessed inward, an outer surface of the side wall of the atomizing core module protrudes outward to form at least one locating portion, the at least one locating portion is disposed corresponding to the at least one locating groove, when the at least one locating portion is assembled to the at least one locating groove, the side wall of the atomizing core module is fastened with the bushing.

7. The atomizing device as claimed in claim 1, further comprising at least one sealing element, a bottom of the atomizing assembly being equipped with a combining portion, the at least one sealing element being assembled at a junction between the fixing element and the flowing channel, a junction between the fixing element and an inner surface of the outer wall of the liquid containing module, and a junction between the combining portion and the atomizing core module.

8. The atomizing device as claimed in claim 1, wherein a bottom of the atomizing assembly is equipped with a combining portion, the combining portion has a fixing space penetrating through a top and a bottom of the combining portion, a bottom of the atomizing core module is assembled in the fixing space.

9. The atomizing device as claimed in claim 8, wherein two sides of an upper portion of an inner surface of the fixing space protrude face to face to form two stopping portions, two lower portions of two sides of the atomizing core module protrude oppositely to form two stepping portions, the two stepping portions move upward along a distance to bottoms of the two stopping portions.

10. The atomizing device as claimed in claim 8, wherein at least one side of the bottom of the combining portion of the atomizing assembly protrudes downward and then protrudes inward to form at least one buckling portion, the atomizing device further includes a rod element, at least one side of the upper portion of the inside of the rod element is equipped with at least one buckling element, the at least one buckling element is corresponding to the at least one buckling portion, the at least one buckling element and the at least one buckling portion are buckled with each other to fasten the atomizing assembly with the rod element.

11. The atomizing device as claimed in claim 10, wherein the rod element has at least one pressing perforation, a lower portion of one side of the at least one buckling element protrudes outwardly to form a pressing portion, a lower portion of the other side of the at least one buckling element protrudes inward and opposite to the pressing portion to form a fixing pillar, a top of the pressing portion protrudes upward and then protrudes outward to form a hooking portion, the hooking portion of the at least one buckling element hooks a tail end of the at least one buckling portion, one side of the pressing portion projects outward from the at least one pressing perforation, the fixing pillar of the at least one buckling element is worn by an elastic element.

12. The atomizing device as claimed in claim 1, wherein when the atomizing core module and the bushing move upward to the top of the fixing element along a distance, the atomizing core module and the bushing are blocked by the top of the fixing element, two sides of the side wall of the accommodating space have two first liquid guiding grooves, two sides of the side wall of the bushing have two second liquid guiding grooves, two sides of the side wall of the atomizing core module have two third liquid guiding grooves, the two first liquid guiding grooves, the two second liquid guiding grooves and the two third liquid guiding grooves are aligned, the two first liquid guiding grooves, the two second liquid guiding grooves and the two third liquid guiding grooves are connected.

13. The atomizing device as claimed in claim 12, wherein the atomizing core module includes an outer tube, an inner tube, a non-woven material and a heating unit, the heating unit is mounted in the outer tube and the inner tube, the outer tube is mounted to a top of the inner tube, the non-woven material is mounted in the outer tube, and the outer tube surrounds the heating unit, the non-woven material is mounted between the heating unit and the two third liquid guiding grooves.

14. An atomizing device, comprising:

a liquid containing module, an inside of the liquid containing module having a fixing element and a liquid storage container, a middle of an inside of the liquid containing module having a flowing channel penetrating through a top of the liquid containing module and extending downward, the flowing channel being communicated with a top of the fixing element, the liquid storage container surrounding a peripheral wall of the flowing channel and an outer surface of the fixing element, the fixing element having an accommodating space penetrating through the top of the fixing element and a bottom of the fixing element, a side wall of the accommodating space having at least one first liquid guiding groove, a bottom of the accommodating space having an opening, the opening being communicated between the accommodating space and the at least one first liquid guiding groove, an inside of the accommodating space being equipped with a bushing, a side wall of the bushing having at least one second liquid guiding groove, the bushing moving upward or downward in the accommodating space, so that the at least one first liquid guiding groove and the at least one second liquid guiding groove being connected or disconnected; and an atomizing assembly mounted under the liquid containing module, the atomizing assembly being equipped with an atomizing core module, the atomizing core module being assembled in the bushing, a side wall of the atomizing core module having at least one third liquid guiding groove, the atomizing core module and the bushing moving upward or downward in the accommodating space to make the at least one second liquid guiding groove and the at least one third liquid guiding groove move upward or downward, the at least one second liquid guiding groove and the at least one third liquid guiding groove being aligned with or misaligned with the at least one first liquid guiding groove, the at least one second liquid guiding groove and the at least one third liquid guiding groove being connected with or disconnected from the at least one first liquid guiding groove;

wherein when the atomizing core module and the bushing move upward to the top of the fixing element along a distance, the atomizing core module and the bushing are blocked by the top of the fixing element, the at least one first liquid guiding groove, the at least one second liquid guiding groove and the at least one third liquid guiding groove are aligned, and the at least one first liquid guiding groove, the at least one second liquid guiding groove and the at least one third liquid guiding groove are connected, so that the liquid containing module is located at an opened status, when the atomizing core module and the bushing move downward to the bottom of the fixing element, the at least one first liquid guiding groove, the at least one second liquid guiding groove and the at least one third liquid guiding groove are misaligned, and the at least one first liquid guiding groove, the at least one second liquid guiding groove and the at least one third liquid guiding groove are disconnected, so that the liquid containing module is located at a closed status.

15. An atomizing device, comprising:

a liquid containing module having an outer surrounding wall and an inner surrounding wall, the outer surrounding wall surrounding the inner surrounding wall, the outer surrounding wall being spaced from the inner surrounding wall, a liquid storage container being formed between the outer surrounding wall and the inner surrounding wall, a flowing channel being surrounded by a top portion of the inner surrounding wall, and an accommodating space being surrounded by a bottom portion of the inner surrounding wall and being communicated with the flowing channel, the bottom portion of the inner surrounding wall having at least one first liquid guiding groove, the at least one first liquid guiding groove being communicated between the liquid storage container and the accommodating space;

a bushing, a side wall of the bushing having at least one second liquid guiding groove, the bushing moving upward or downward in the accommodating space, so that the at least one first liquid guiding groove and the at least one second liquid guiding groove being connected or disconnected;

an atomizing assembly mounted under the liquid containing module, the atomizing assembly being equipped with an atomizing core module, the atomizing core module being assembled in the bushing, a side wall of the atomizing core module having at least one third liquid guiding groove, the atomizing core module and the bushing moving upward or downward in the accommodating space to make the at least one second liquid guiding groove and the at least one third liquid guiding groove move upward or downward, the at least one second liquid guiding groove and the at least one third liquid guiding groove being aligned with or misaligned with the at least one first liquid guiding groove, the at least one second liquid guiding groove and the at least one third liquid guiding groove being connected with or disconnected from the at least one first liquid guiding groove; and a rod element mounted under the atomizing assembly.

* * * * *